United States Patent [19]

Heathcoat et al.

[11] Patent Number: 4,515,677

[45] Date of Patent: May 7, 1985

[54] APPARATUS FOR ELECTROCOATING

[75] Inventors: Michael J. Heathcoat, Faringdon; Douglas H. Jackson; Frederick W. Jowitt, both of Wantage; Jack R. Madley, Garsington; Ian C. E. Stuart, Nr. Abingdon, all of England

[73] Assignee: Metal Box Limited, Reading, England

[21] Appl. No.: 517,740

[22] Filed: Jul. 29, 1983

Related U.S. Application Data

[63] Continuation of Ser. No. 309,350, Oct. 7, 1981.

[30] Foreign Application Priority Data

Oct. 15, 1980 [GB] United Kingdom ..... 8033282

[51] Int. Cl.[3] ..... C25D 13/14

[52] U.S. Cl. ..... 204/300 EC; 204/181 R; 204/181 C; 204/299 EC

[58] Field of Search ..... 204/181 R, 181 C, 299 EC, 204/300 EC

[56] References Cited

U.S. PATENT DOCUMENTS

| | | | |
|---|---|---|---|
| 3,305,467 | 2/1967 | Igras et al. | 204/300 EC |
| 4,082,642 | 4/1978 | Hönig et al. | 204/300 EC |
| 4,094,760 | 6/1978 | Smith et al. | 204/181 C |
| 4,107,016 | 8/1978 | Brower et al. | 204/181 C |
| 4,246,088 | 1/1981 | Murphy et al. | 204/181 C |
| 4,400,251 | 8/1983 | Heffner et al. | 204/300 EC |

*Primary Examiner*—R. L. Andrews
*Assistant Examiner*—Terryence Chapman
*Attorney, Agent, or Firm*—Sughrue, Mion, Zinn, Macpeak and Seas

[57] ABSTRACT

A method of electrocoating the surface of an article such as the internal surface of a can body using as electrode a mandrel having an external surface of substantially the same shape as the surface to be coated. The can body is positively located in a cell containing the mandrel by way of a seal in the cell wall and a limiting surface such that the internal surface to be electrocoated is substantially equidistantly spaced from the mandrel. Electrocoating fluid is flowed by way of a central bore in the mandrel between the mandrel and the internal surface and one or more electrocoating pulses are applied between the mandrel and the can body to electrocoat the internal surface thereof.

8 Claims, 3 Drawing Figures

APPARATUS FOR ELECTROCOATING

This application is a continuation of application Ser. No. 309,350, filed Oct. 7, 1981.

BACKGROUND OF THE INVENTION

The present invention relates to a method of, and apparatus for, electrocoating a surface of an article.

SUMMARY OF THE INVENTION

According to a first aspect of the invention there is provided a method of electrocoating a surface of an article using an electrode having a surface of substantially the same shape as the surface of the article to be electrocoated, the method comprising the steps of positively locating the article such that the surface thereof to be electrocoated is substantially equidistantly spaced from the surface of the electrode, the distance between said surface of the article and said surface of the electrode being in the range 0.25 to 5.00 mm, flowing an electrocoating fluid between the electrode and said surface of the article, and applying one or more electrocoating pulses between the electrode and the article to electrocoat said surface of the article.

By use of an electrode-article spacing within the range 0.25 mm to 5.0 mm, the electrodeposition time can be kept small (for example 300 msecs for a can body open at one end); in addition, the volume of electrocoating fluid required is minimised, as is the likelihood of void formation in the electrocoating fluid with consequent impairment of the electrocoating process. Thus, electrode-article spacings within the stated range may enable an electrocoating apparatus to be provided which is capable of reliable high speed operation and yet which is compact and inexpensive to build and to operate.

According to a further aspect of the invention there is provided a method of electrocoating a surface of an article using an electrode having a surface of substantially the same shape as the surface of the article to be electrocoated, the method comprising the steps of positively locating the article such that the surface thereof to be electrocoated is substantially equidistantly spaced from said surface of the electrode, flowing an electrocoating fluid between the electrode and said surface of the article, checking for separation between the electrode and said surface of the article and, if separation is established, applying one or more electrocoating pulses between the electrode and the article to electrocoat said surface of the article.

If articles are being coated on an automatic apparatus it is important to ensure that there is not a short circuit between the article and the electrode as the application of electrocoating pulses where there is a short circuit could damage the apparatus. Thus, electrocoating pulses are not applied unless separation is established.

According to a still further aspect of the invention there is provided a method of electrocoating a surface of an article using an electrode having a surface of substantially the same shape as the surface of the article to be electrocoated, the method comprising the steps of positively locating the article such that the surface thereof to be electrocoated is substantially equidistantly spaced from the surface of the electrode, flowing an electrocoating fluid between the electrode and said surface of the article, and applying one or more electrocoating pulses between the electrode and the article to electrocoat said surface of the article, the total duration of the electrocoating pulses being in the range 10 msec to 500 msec.

The use of one or more electrocoating pulses having a total duration within the stated range enables an electrocoating apparatus to be provided which is capable of high speed operation and yet which is compact and inexpensive to build and to operate.

The present invention also extends to a method of electrocoating a surface of an article using an electrode having a surface of substantially the same shape as the surface of the article to be electrocoated, the method comprising the sequential steps of positively locating the article such that the surface thereof to be electrocoated is substantially equidistantly spaced from said surface of the electrode, flowing an electrocoating fluid between the electrode and said surface of the article, applying one or more electrocoating pulses between the electrode and the article to electrocoat said surface of the article, ceasing the flow of the electrocoating fluid between the electrode and said surface of the article, and flowing a rinsing fluid between the electrode and said surface of the article, the electrocoating fluid comprising an electrolytic fluid and coating material which is dissolved or dispersed in the electrolytic fluid, and said rinsing fluid being said electrolytic fluid.

The rinsing fluid will be compatible with the coating material so that the rinsing operation will be efficient. Furthermore, as the rinsing fluid is electrolytic the resistance between the article and the electrode can be measured to determine the quality of the coating deposited.

In an embodiment for electrocoating the internal surface of a can a cell is used which comprises a cylindrical housing of insulating material having a fixed base and a movable lid, and a mandrel extending axially within said housing and having a fluid passage extending axially therethrough, the mandrel constituting said electrode, and the housing being arranged to receive a can in the inverted position and having guide means for positively locating the can.

In an embodiment for electrocoating the external base surface of a can a cell is used which comprises a cylindrical housing of insulating material having a fixed base and a movable lid, the housing being arranged to receive a can in the inverted position and having guide means for positively locating the can, the lid carrying said electrode and being arranged to engage in a predetermined position on said housing, and a fluid passage extending through said electrode coaxially of said housing.

The invention also extends to apparatus for electrocoating a surface of an article comprising a cell including an electrode having a surface of substantially the same shape as the surface of the article to be electrocoated and means for positively locating the article such that the surface thereof to be electrocoated is substantially equidistantly spaced from said surface of the electrode, the apparatus further comprising means for flowing an electrocoating fluid between the electrode and said surface of the article and means for applying one or more electrocoating pulses between the electrode and the article.

BRIEF DESCRIPTION OF THE DRAWINGS

An embodiment of the present invention will hereinafter be described, by way of example, with reference to the accompanying drawings, in which.

DESCRIPTION OF A PREFERRED EMBODIMENT

It is known to coat electrically conducting surface areas of articles by electrodeposition using a cell in which the article is positioned such that the surface thereof to be coated is spaced from an electrode of the cell. An electrocoating fluid including a dispersed or dissolved organic coating material is contained within the cell and an electrical potential is applied between the cell electrode and the article which acts as the other electrode. A coating of the organic material is thereby deposited on the surface of the article.

Where tubular bodies such as can bodies which open at one or both ends are to be coated, a cell having a cylindrical outer wall and an axially extending central mandrel therein will generally be provided. Each can body will then be positioned in a respective cell such that it is spaced from the central mandrel and the outer wall. Means will be provided to make electrical connection with the can body and with the central mandrel and/or the outer wall. Thus, if the inner surface of the can body is to be coated the central mandrel and the can body will form the electrodes of the cell. If the outer surface of the can body is to be coated, the can body and the outer wall of the cell will form the electrodes. In addition, both surfaces of the can body can be coated either simultaneously or successively if an electrical potential is applied both between the can body and the mandrel and between the can body and the outer wall.

Figure 1:
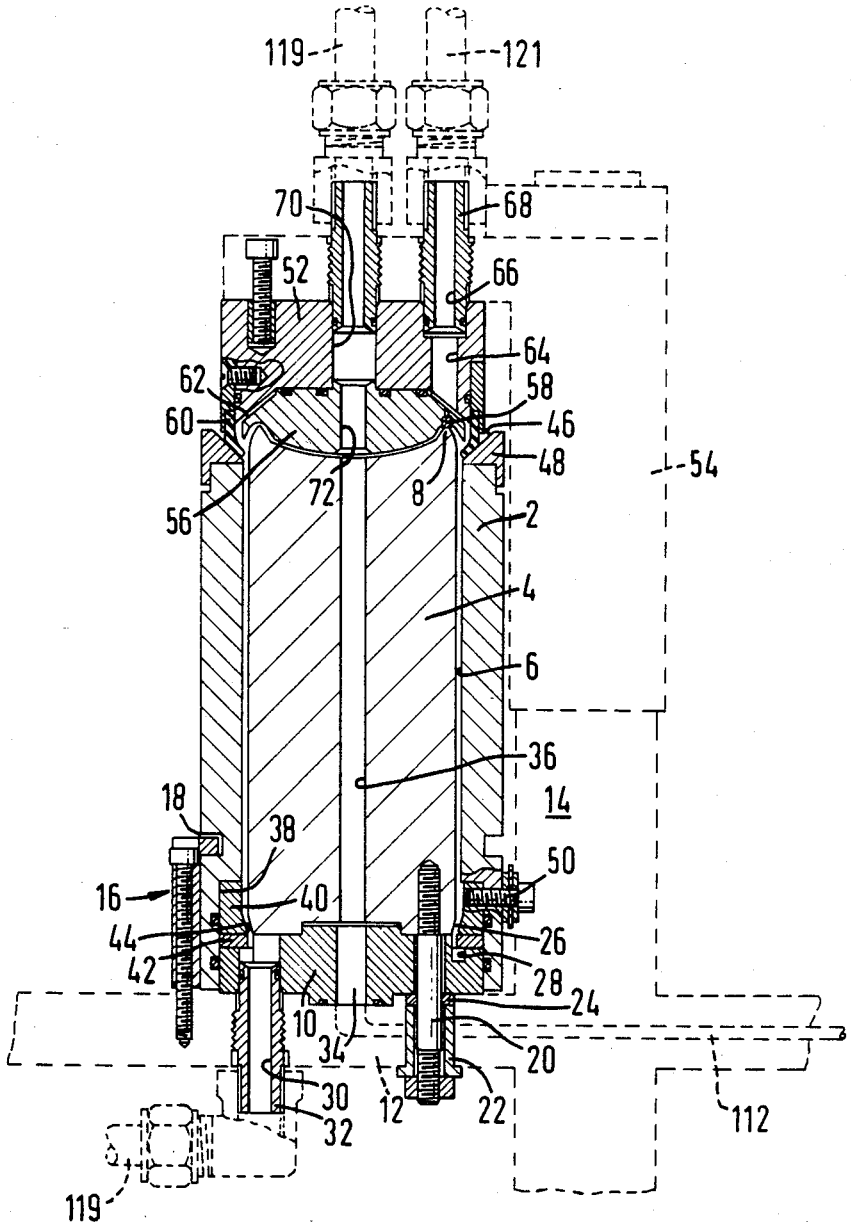
FIG. 1 shows a longitudinal section through a cell in which a can body can be electrocoated.

FIG. 1 shows an example of a cell which can be used to coat both the internal surface and the external base surface of a can body closed at one end. The cell shown in FIG. 1 has a cylindrical outer wall 2 made of an electrically insulating material, for example, polypropylene, and a mandrel 4 made of an electrically conductive material centrally positioned therein. The mandrel 4, which may be made of stainless steel, is substantially cylindrical and is arranged to extend within the outer wall 2 coaxially therewith.

A space 6 is defined between the wall 2 and the mandrel 4 for the receipt of a can body (not shown) to be electrocoated. In the embodiment illustrated, the can body is placed over the mandrel 4 in the inverted position. The can body is of the kind having a cylindrical (i.e. unnecked or unbeaded) side wall.

The external surface of the mandrel 4 conforms substantially identically to the shape of the internal surface of the can body to be coated. However, the external surface of the mandrel 4 is slightly smaller than the internal surface of the can body so that the can body can be positioned in the cell spaced from the mandrel 4. It is preferred that the spacing between the mandrel 4 and can body is in the range 0.25 to 5.00 mm and generally it will be in the range 1.00 to 1.75 mm. In the embodiment illustrated the nominal spacing is 1 mm. Over a substantial proportion of the can body the spacing is constant at this value. Locally, however, the spacing may differ from this constant value in order to achieve as uniform a coating thickness as possible. Thus, where the mandrel 4 is shaped to conform to an annular rim provided on the base of the can body, the corresponding rim 8 provided on the mandrel 4 is provided with a radius on its projecting edge.

The mandrel 4 is detachably mounted on an extension 12 of an arm 14 by threaded studs 20, of which only one is visible. The mandrel is electrically insulated from the arm 14, being spaced from the arm by a spacer member 10 of an electrically insulating material such as polypropylene; in addition, the studs are insulated from the arm 14 by insulating sleeves 22. Rubber washers 24 are located between the sleeves and the spacer member to provide fluid-tight seals preventing escape of electrocoating fluid from the cell along the studs. One of the studs 20 is used as an electrical terminal by which electrocoating pulses can be applied to the mandrel 4 as will later become apparent.

The base of the mandrel 4 is chamfered at 26 and the base perimeter thereof is aligned with the internal wall of annular groove 28 provided in the base member 10. This groove 28 is in communication with an axial bore 30 within a sleeve 32 which extends through the extension 12 into the base member 10. An axial bore 34 extends through the base member 10 and is aligned with an axial bore 36 extending the length of the mandrel 4. It will therefore be appreciated that when an inverted can body with a closed end is placed in position over the mandrel 4 a fluid path will be defined by the aligned bores 34 and 36, the space between the external surface of the mandrel 4 and the can body, the chamfer 26, the groove 28 and the axial bore 30.

The outer wall 2 of the cell is releasably attached to the extension 12 of the arm 14 by spaced clamps 16 which engage in an external annular groove 18 extending around the wall 2.

At its bottom end, the outer wall 2 has a stepped internal surface defining an annular recess 38. This recess 38 houses means for positively locating a can body and for making an electrical connection thereto. In the recess 38 there is provided an annular metal seal 40. The bottom end of the seal is dimensioned so that the free edge of a can body to be electrocoated is a push fit within it. Above its bottom end the seal is relieved from engagement with the can body, but provides a frustoconical surface leading into the bottom end to provide guidance for the can body as it enters the latter.

The seal 40 is supported on an annular ring 42 which has a smaller internal diameter than the seal and thus defines an annular surface 44 for providing a positive limit for movement of a can body down the cell.

A can body is inserted in the cell illustrated in the inverted position such that its cylindrical wall is received in the space 6. It is initially guided into the cell by an inclined guide surface 46 formed on an annular metal insert 48 fixed on the top rim of the outer wall 2. This insert 48 protects the outer wall 2 against wear.

The can body is inserted into the cell whilst a vacuum is applied to the bores 34 and 36 to assist the insertion. The can body is moved down the space 6 until its free edge contacts the limiting surface 44 around its periphery. In this position the part of its outer wall adjacent its free edge will be gripped by the seal 40 in an electrically conductive manner, and the can body will be positively located around the mandrel 4 and spaced therefrom. The can body will also be spaced from the outer wall 2 of the cell.

Electrical contact is at the same time made with the can body by way of the seal 40 and of a contact screw 50 which is screwed into the seal.

At the top, the cell is provided with a detachable lid 52 carried by an arm 54 telescopically and rotatably mounted on the arm 14. In the embodiment illustrated the lid 52 carries an electrode 56 to enable the external base surface of the can body to be electrocoated. In a modification, however, coating of the base surface of the can body is not required, and a simplified lid is accordingly provided.

The lid 52 carries an annular flexible seal 60 which is arranged to contact the insert 48 on the outer wall 2 when the lid is closed.

The electrode 56 is detachably affixed to the lid 52 by a number of screws (not shown), one of which is arranged to provide electrical connection thereto. The upper surface of the electrode 56 is shaped so as to define an annular inclined groove 62 between the electrode and the lid which is in communication with a bore 64 in the lid 52 which in turn communicates with a bore 66 in a sleeve 68. In addition, aligned bores 70 and 72 extend axially of the lid and the electrode. Accordingly, when a can body is in position in the cell a flow path for fluids is defined by the bores 70 and 72, by the space between the electrode 56 and the can body, by the groove 62 and finally by the bores 64 and 66. The bore 70 is connected in series with the bore 30 previously mentioned by a pipe 119 of which the two ends are shown.

The cell described above is designed for use with apparatus having a plurality of such cells movable successively to a number of operating stations. Such an apparatus illustrated in FIGS. 2 and 3.

Figure 2:
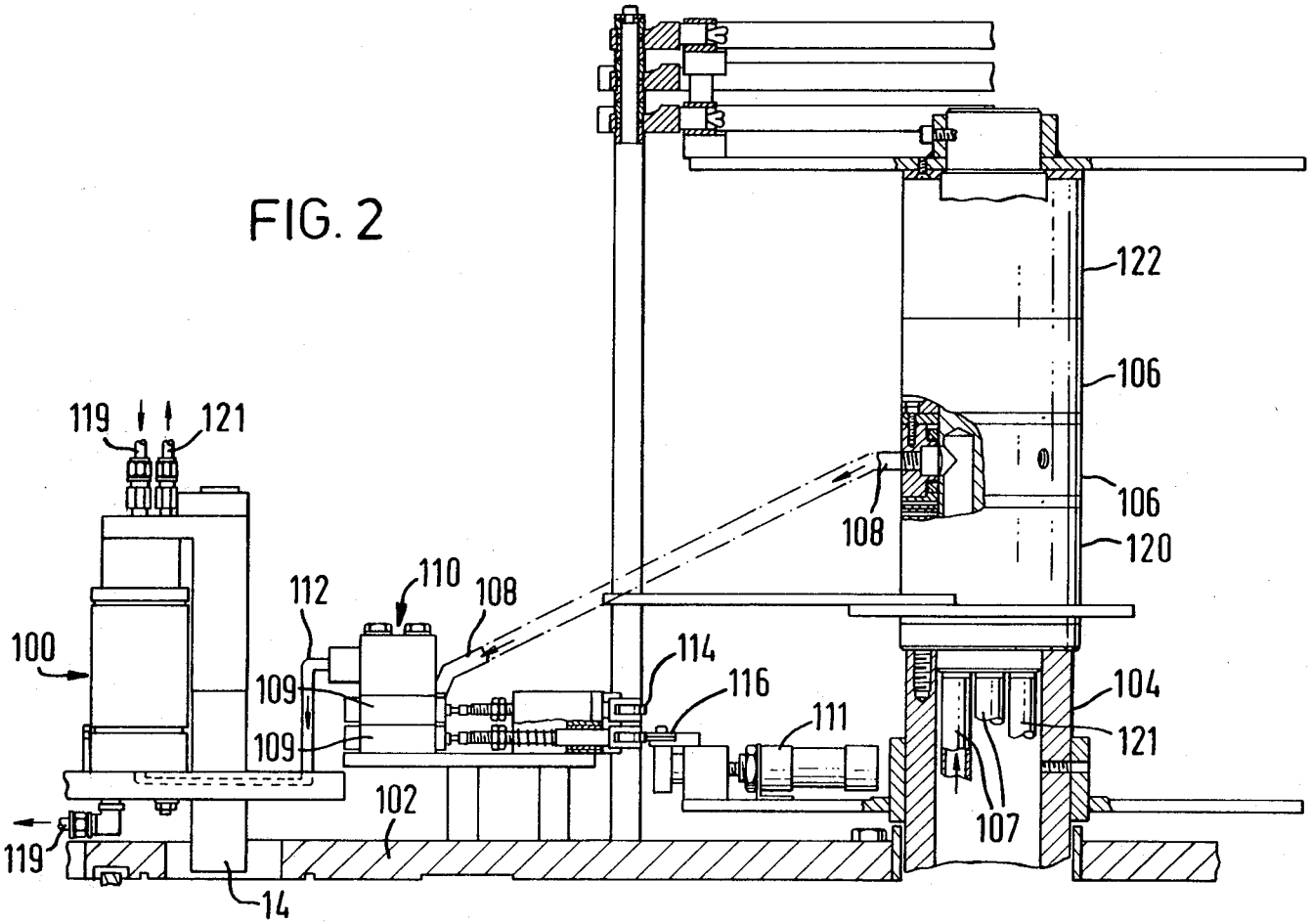
FIG. 2 shows an elevation, partly in section of part of an electrocoating apparatus including a number of the cells of FIG. 1.

As shown in FIG. 2 a plurality of cells 100 are equally spaced circumferentially on a rotatable turntable 102. The arm 14 of each cell is fixed to the turntable 102. The turntable is rotatable about a central column 104 which carries two rotatable joints 106 and a further rotatable joint 120 for providing separate rotatable connections for two supply pipes 107 and a common return pipe 121 which are located within the column 104. One of the supply pipes 107 is connected to a source of electrocoating fluid, the other supply pipe being connected to a source of rinsing fluid; the nature of these two fluids is described hereinbelow.

Each joint 106 is connected by pipes 108 to a number of cam operated stop valve assemblies 110 which are mounted at regular intervals around the turntable 102 for rotation therewith. Each assembly 110 is connected by a branched outlet pipe 112 for supplying a respective group of three of the cells 100, and has a valve 109 for each of the two incoming pipes 108. Further pipes 121 connect the cells to the rotatable joint 120. The valves 109 have respective cam followers 114 engageable with essentially fixed cams 116. Accordingly, as the turntable rotates, fluids from the pipes 107 are fed to each cell 100 in accordance with a preset sequence and are returned via the pipes 121. In case it should at any time be required to inhibit the feed of fluid from one or more of the pipes 107 to the cells, the cams 116 are mounted on actuators 111 which can be pneumatically operated to withdraw the cams to retracted, inoperative positions.

The apparatus is not further described herein as the manner in which sequential operations can be controlled is within the competence of any one skilled in the art.

Figure 3:
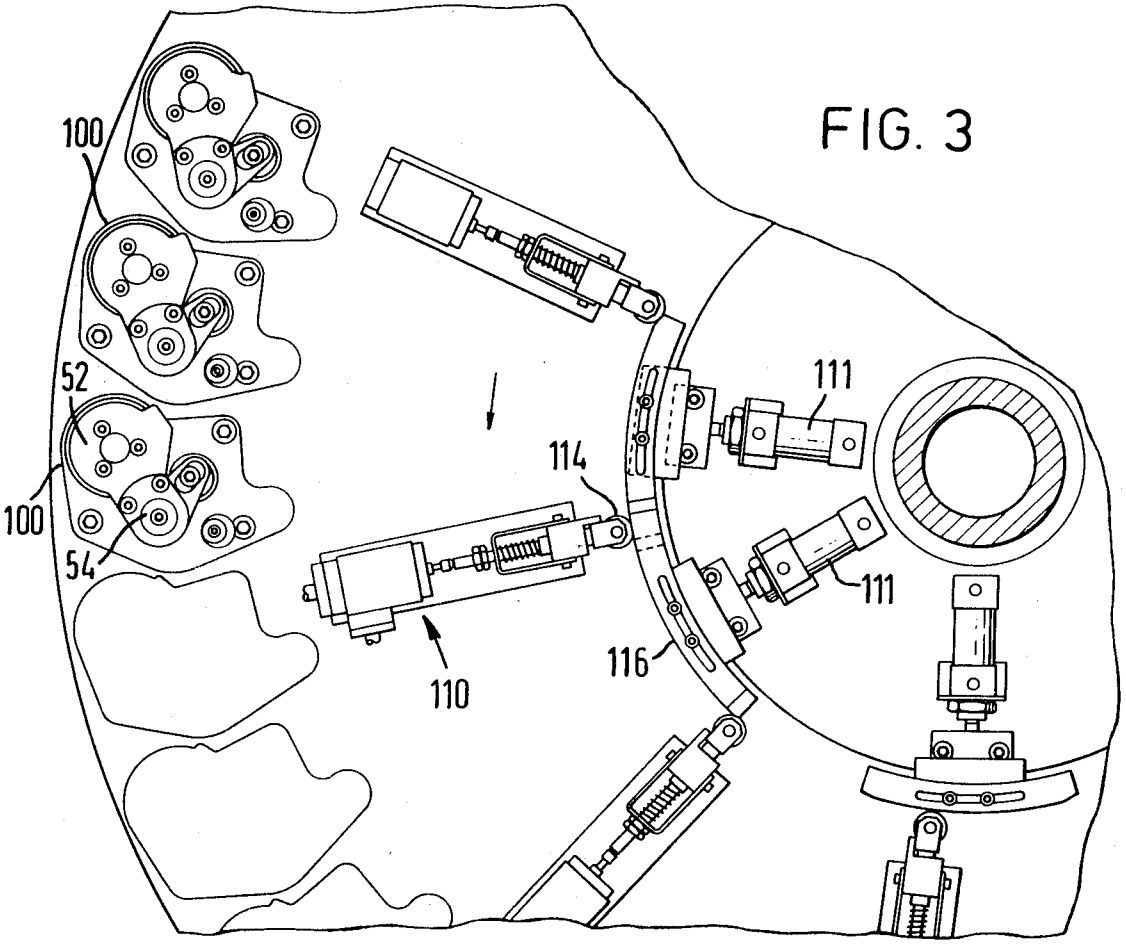
FIG. 3 shows a plan view of part of the apparatus of FIG. 2.

The apparatus of FIGS. 2 and 3 is also provided with means to insert a can body into each cell at a loading station and to remove a can body from the cell at an unloading station. As such means are known they are not illustrated herein.

In order to electrocoat the bodies it is required to apply electrical pulses to the cells at predetermined stations of the apparatus. The electrical pulses are applied to the cells at their terminal studs 20 and contact screws 50 previously mentioned. They are supplied from an electrical supply and monitoring circuit via two segmented slip rings (not shown) each having one segment for each cell. The cells are connected electrically in series with, and between, their respective slip ring segments, so as to be energised in sequence as the turntable 102 rotates. The electrical circuit is not described herein but an example of a suitable circuit is illustrated and described in copending U.S. application Ser. No. 309,349 filed Oct. 7, 1981 entitled "Electrocoating Apparatus" and claiming priority from British Patent Application No. 8033283. The disclosure of this copending U.S. application is incorporated herein by reference.

The sequence of operations performed by the apparatus will now be described with reference to a single cell 100 as it is moved successively from a machine input to a machine discharge through the number of discrete operating stations defined by the apparatus.

Initially, the arm 54 is raised and rotated relative to the arm 14 so that the lid 52 is not in position on the outer wall 2. The cell is thus open and a can body can be loaded therein assisted by application of vacuum pressure to the bore 34 as described above. Thereafter the lid 52 is closed onto the outer wall 2. In its closed position the lid resiliently urges the can body against the limiting surface 44 by means of spacing studs 58.

As the material of a can body is generally thin it may be deformed as it is drawn into the cell under vacuum. Accordingly, it is preferred that the electrocoating fluid to be used then be fed to the cell via the bore 34 (and 70), so as to pressurise the interior of the can body and thereby ensure that there is adequate separation between the can body and the electrodes for electrocoating. As it is important that the electrocoating voltage pulses are not applied to a cell in which there is a short circuit, as an additional precaution each cell is tested for a short circuit before the pulses are applied. The short circuit test may be performed in any suitable manner capable of establishing that there is separation between the can body and the electrode. For example, means could be provided to determine the existence of a physical space. Alternatively, the resistance between the can body and the electrode could be measured to determine that it is above a predetermined value. The manner in which the test is performed is not described in detail as various means can be used.

If the short circuit test establishes that there is separation between the can body and the electrode, electrocoating pulses are applied to the cell with the electrocoating fluid still flowing therethrough. The can body is electrocoated thereby.

The time needed to electrocoat an article is dependent, inter alia, upon the electrode spacing and the coulombic yiel of the electrolyte. These factors can be chosen to give very short deposition times. For example, deposition times of 300 msec can be achieved using an electrode spacing nominally of 1 mm and an electrolyte having a yield of 40 mgm/coulomb. However, so that the design speed of the apparatus does not have to be reduced to enable the use (for each cell) of a single electrocoating pulse of a sufficiently long duration to achieve a satisfactory coating thickness, more than one pulse may be applied to each cell, and the cells energised two or more at a time. In the embodiment illustrated three separate pulses each of 100 msec. duration are applied to each cell, and the cells are energised sequentially and progressively three at a time to give a total deposition time per cell of 300 msecs. The total duration of the one or more electrocoating voltage pulses applied to each cell will usually be in the range 10 msec to 500 msec; their voltage will typically be in the range 60 to 250 volts.

At the end of the electrocoating operation, that is, once the application of pulses thereto has ceased, the supply of electrocoating fluid to the cell is cut off. Subsequently air is applied to the bores 34 and 70 (via bore 30 and pipe 119) to purge the cell; this air is supplied by a rotatable joint 122 on the central column 104, and pipes (not shown) connecting the joint 122 directly to the cells.

Thereafter the cell is rinsed by applying similarly a rinsing fluid to the bores 34 and 70. This rinsing fluid will flow along the flow paths defined within the cell and remove any loose coating material within the cell.

The electrocoating fluid is formed of an electrolytic fluid and coating material which is dissolved or dispersed in the electrolytic fluid. For the coating material, anodic and cathodic systems and acrylic, epoxy, polyester and butadience types have all been used successfully.

The electrolytic fluid is an electrically conductive carrier fluid for the coating material, and may include additives such as solvents and solubilising agents.

It is preferred that the rinsing fluid should be the electrolytic fluid alone (i.e. without the coating material added). The rinsing fluid will then be compatible with the coating material and the rinsing operation will be efficient.

Once the cell has been rinsed it is subjected to a further air purge. Thereafter, the coated can body is removed from the cell. Firstly, a vacuum is applied to bore 34 to hold the can body in the cell whilst the lid is raised. Once the cell is open the can body is blown out of the cell by applying air to the bore 34.

In the embodiment described above, both the internal surface of the can body and the external base surface thereof are coated simultaneously. However, such coating of two parts of the surface area of the can body could be performed consecutively if preferred.

Although the apparatus has been described with particular reference to can bodies closed at one end, it will be appreciated that the invention is applicable to the electrocoating of can bodies open at both ends, or of other articles. Moreover, it may be applied to any desired part or parts of the surface area of an article. Where two or more parts are involved, the parts may be contiguous (for example, along a free edge of the article), or they may be separate. Can bodies to which the invention may be applied may have cylindrical side walls (as in the described embodiment), or may have side walls which are necked or beaded inwardly around their circumference.

We claim:

1. Apparatus for electrocoating internal and external surfaces of a can, said apparatus comprising: a cell including a cylindrical housing (2) having a fixed base and a movable lid (52), a mandrel (4) extending axially within said housing, the mandrel (4) forming a first electrode having a surface of substantially the same shape as the internal surface of a can to be electrocoated, a first fluid passage (36) extending axially through said mandrel, a second electrode (56) carried by said cylindrical housing, the second electrode having a surface of substantially the same shape as an external surface of a can to be electrocoated, a second fluid passage (72) extending through said second electrode coaxially of said housing, and guide means (40, 44) carried by said housing and arranged to positively locate a can in an inverted position in the housing such that the first electrode is uniformly spaced from the internal surface of the can and the second electrode is uniformly spaced from the external surface of the can, said guide means also forming contact means (40, 50) arranged to make electrical contact with a can received within the housing, wherein said guide means comprises an annular metal seal (40) carried by said housing and dimensioned such that the free edge of a can to be electrocoated is a push fit therewithin whereby said metal seal positively locates the can and makes electrical contact therewith, and wherein said contact means also comprises a contact (50) electrically connected to said metal seal, means for flowing an electrocoating fluid between each surface of the can and the corresponding surface of the first and second electrodes, and means for applying at least one electrocoating pulse between each of said first and second electrodes and the can, the total duration of electrocoating pulses being in the range 10 msec to 500 msec.

2. A cell for electrocoating internal and external surfaces of a can, said cell comprising: a cylindrical housing (2) having a fixed base and a movable lid (52), a mandrel (4) extending axially within said housing, the mandrel (4) forming a first electrode having a surface of substantially the same shape as the internal surface of a can to be electrocoated, a first fluid passage (36) extending axially through said mandrel, a second electrode (56) carried by said cylindrical housing, the second electrode having a surface of substantially the same shape as an external surface of a can to be electrocoated, a second fluid passage (72) extending through said second electrode coaxially of said housing, and guide means (40, 44) carried by said housing and arranged to positively locate a can in an inverted position in the housing such that the first electrode is uniformly spaced from the internal surface of the can and the second electrode is uniformly spaced from the external surface of the can, said guide means also forming contact means (40, 50) arranged to make electrical contact with a can received within the housing, wherein said guide means comprises an annular metal seal (40) carried by said housing and dimensioned such that the free edge of a can to be electrocoated is a push fit therewithin whereby said metal seal positively locates the can and makes electrical contact therewith, and wherein said contact means also comprises a contact (50) electrically connected to said metal seal.

3. A cell according to claim 2, wherein an annular recess (38) is defined in the bottom end of said cylindrical housing facing said mandrel and said metal seal (40) is received therein, and wherein an annular ring (42) is carried by said cylindrical housing and is arranged to support said metal seal, said annular ring having a smaller internal diameter than that of said metal seal whereby an annular stop surface (44) for the free edge of a can to be electrocoated is formed.

4. A cell according to claim 3, wherein said annular metal seal has a cylindrical internal surface having an internal diameter arranged to be substantially equal to the external diameter of a can to be electrocoated, and wherein said annular metal seal also has a frustoconical internal surface below said cylindrical surface and continuing therefrom to provide a guide surface for the free edge of a can to be electrocoated.

5. A cell according to claim 2, wherein said annular metal seal has a cylindrical internal surface having an internal diameter arranged to be substantially equal to the external diameter of a can to be electrocoated, and wherein said annular metal seal also has a frustoconical internal surface below said cylindrical surface and continuing therefrom to provide a guide surface for the free edge of a can to be electrocoated.

6. A cell according to claim 2, wherein said cylindrical housing has a cylindrical outer wall (2) made of insulating material, and said second electrode (56) is carried by said movable lid, said second electrode being arranged for the electrocoating of the external base surface of a can and having a surface of substantially the same shape as that of the external base surface.

7. A cell according to claim 6, wherein an annular metal insert (48) is fixed to the top rim of said cylindrical outer wall (2), and an inwardly inclined guide surface (46) is formed on said metal insert, and wherein an annular flexible seal (60) is carried by said movable lid and is arranged to contact said insert when the lid is in a closed position.

8. A cell according to claim 2, wherein said guide means are arranged to positively locate a can therewithin such that each surface of the can to be electrocoated is spaced from the corresponding surface of the first and second electrodes by a distance in the range 0.25 to 5.00 mm.

* * * * *